US005206088A

United States Patent [19]

Raevsky

[11] Patent Number: 5,206,088

[45] Date of Patent: Apr. 27, 1993

[54] ABLATIVE-INTUMESCENT SYSTEM

[75] Inventor: Vitaly Raevsky, Cherry Hill, N.J.

[73] Assignee: Development Products, Inc., Pennsauken, N.J.

[21] Appl. No.: 792,031

[22] Filed: Nov. 13, 1991

[51] Int. Cl.[5] ..... B32B 27/38; B27N 9/00; C08K 3/34

[52] U.S. Cl. ..... 428/413; 428/432; 428/469; 428/472.2; 428/537.1; 428/522; 428/689; 428/704; 428/920; 428/921; 523/179

[58] Field of Search ..... 428/920, 921, 413, 522, 428/432, 469, 472.2, 537.1, 689, 704; 523/179

[56] References Cited

U.S. PATENT DOCUMENTS

| | | | |
|---|---|---|---|
| 4,076,580 | 2/1978 | Pamisch et al. | 428/921 X |
| 4,212,920 | 7/1980 | Seamans | 428/413 |
| 4,818,595 | 4/1989 | Ellis | 428/921 X |

*Primary Examiner*—P. C. Sluby
*Attorney, Agent, or Firm*—Simpson & Simpson

[57] ABSTRACT

A method and material for the protection of construction materials against the thermal effects of fire comprising an ablative layer coated on the fire-exposed surface with an intumescent paint.

6 Claims, No Drawings

ABLATIVE-INTUMESCENT SYSTEM

BACKGROUND OF THE INVENTION

The present invention relates to the protection of various construction materials from the effects of heat and fire.

There are in general three major categories of materials which provide heat-insulating or fire-retarding characteristics when applied to the surface of construction materials. The most common of these are porous or fibrous materials which exhibit low heat conductivity due primarily to the presence of air trapped in the pores or among the fibers of a fibrous batting. In general, the heat conductivity of these materials is not altered by fire or by high temperature, and the heat transfer through the material as a function of time can be generally represented by a straight line up to the point of melting. However, most of these materials melt by the temperature of 1500° to 1800° C. and thus are limited in their usage. For example, they cannot be used as insulating material for rockets where temperatures well in excess of the melting point may be reached.

A second group of materials comprise the ablative materials. These are materials that go through thermal, chemical and/or mechanical degradation in a manner that absorbs or dissipates energy. Aluminate sulfate hydrate is an example of such material. These materials do find use in the rocket industry because of their ability to withstand high temperatures, as well as their significant resistance to heat transfer. Thus, for example, if one side of a 10 mm. thick, porous, ceramic plate is exposed to a temperature in the range of about 750° to 800 ° C., the other side will reach 200° C. in about five to ten minutes. When, however, a 10 mm. thick, porous, ablative type material is subjected to the same treatment, it will take more than an hour for the opposite side to reach 200° C.

A third group of materials is the intumescent materials. Ordinary intumescent materials are compositions that foam or otherwise expand in fire or high temperature conditions to produce insulating material. Within this group are the intumescent coating materials, that is, materials which are specifically designed to be applied in the form of a paint or the like where effect can be illustrated by the treatment of a metal plate. If one side of a 1.6 to 2 mm. metal plate is exposed to a temperature of 950°±50° C., the opposite side will reach 200° C. in about twenty to thirty seconds. On the other hand, if the same metal plate is provided with a coating of an intumescent paint, and the painted side is exposed to the same high temperature, the opposite side will not reach 200° C. until one or two minutes have expired.

SUMMARY OF THE INVENTION

It is an object of this invention to provide a fire and heat-protective material for application to construction materials that overcomes many of the disadvantages of the prior art materials while, at the same time, providing significantly improved heat and fire resistance. These objects are achieved by providing construction materials with a protective layer of an ablative material and by coating the exposed surface of the ablative material with an intumescent paint.

DETAILED DESCRIPTION OF THE INVENTION

It has now been found that the presence of an intumescent paint coating on the surface of an ablative layer can significantly increase the heat-resistance and insulating characteristics of the ablative material well beyond what might be predicted from the individual characteristics of the ablative layer and the intumescent coating. It appears that in this combination, the loss of surface materials of the ablative layer through decomposition and the discharge of the gases and vapors from the surface is significantly slowed down. The pigmentation of the paints and coatings greatly increases the reflections of heat rays from the surface and, finally, the heat-insulating characteristics of the foamed intumescent coating significantly increases the efficiency of the underlying ablative layer, especially at the starting and final stages of flame action. This effect is shown in detail in the examples.

The materials used in the examples are all commercially available products. Thus, for example, ablative material SM-F and ablative material SM-P are products available from Development Products, Inc. of Pennsauken, N.J Product SM-F was prepared by roll milling a 10 gram slab of a high-molecular weight polyisobutylene, having an average molecular weight of approximately 800,000 (Vistanex TM MM L-80), a 7 gram slab of a low molecular weight polyisobutylene, having an average molecular weight of approximately 10,000 (Vistanex TM LM-MH), and 83 grams of aluminum sulfate hydrate (40 grams at 125 mesh and 43 grams at 50 mesh). The temperature during the roll milling process did not exceed 70° C. After roll milling, the mixture was compression molded into sheets.

The product identified as SM-P was a paste consisting of 100 parts by weight of redispersible vinyl acetate-ethylene copolymer latex powder (Airflex RP-244, 0° C. minimum film-forming temperature), 225 parts by weight of $Al_2(SO_4)_3 \cdot 14\ H_2O$ powder, 125 mesh, 220 parts by weight of liquid $Al_2(SO_4)_3$, and 10 parts by weight of sodium silicate (Portil alkaline powder). The last ingredient was added to provide a pH value of about seven and also for more proportional division of ingredients. The operations in preparing the mixture are set forth in the following table:

| | Operation | Time, Min. |
|---|---|---|
| 1. | Backfill all powder components (redispesible latex powder, aluminum sulfate hydrate and sodium silicate in bowl of mixer). | 0.5–1 |
| 2. | Blending of powders at the slowest speed. | 4–5 |
| 3. | Gradual addition of liquid aluminum sulfate with stirring. | 3–4 |
| 4. | Increase of blender speed to higher speed for homogenization of composition. | 2–3 |
| | Total mixing time. | 10–13 |

The resulting composition has the consistency of paste and was trowelable. The product could be formed by compression molding of the composition for 1–2 minutes at room temperature. Drying was carried out for 25–35 days at ambient conditions. The plaster retained its original white color in the process of drying and did not have any odor.

The intumescent paints used were commercially available products. The F.C. 10—10 is a mineral spirits based, flat, intumescent, fire-retardant paint manufactured by Flame Control Coatings, Inc. of Niagara Falls, N.Y. F.C. 20—20 is a waterbase, flat, latex, intumescent, fire- retardant paint also produced by Flame Control Coatings, Inc.

Ocean 477 is an intumescent, fire-retardant, catalytic, epoxy coating manufactured by Ocean Coatings of Savannah, Georgia. In addition, Flaymbar 97888 and Ocean 44 are fire-retardant, thermal barrier coatings useful for the purpose of the present invention. Ocean 44 is a fiber-reinforced intumescent mastic compound that may be applied by spraying. The contact cement used in the example was Weldwood manufactured by DAP of Dayton, Ohio, a subsidiary of U.S.G. Corporation.

For the testing of samples, a ceramic frame is placed on a ring stand and a sample of the material to be tested (160 mm. × 160 mm.) is placed on the ceramic frame. A flame having a temperature of 930±20° C. is applied from underneath to the side of the sample that represents the exposed surface. The surface temperature of the opposite side of the sample is measured continuously. The fire protection response (FPR) is defined herein as the time necessary for the surface of the sample opposite to the flame application side to reach a specified temperature such as 130° C., 170° C., or 212° C.

EXAMPLE 1

Sheetrock plates (160×160×12.5 mm) were treated as shown in Table 1. The coating with intumescent paint 10—10 was applied twice with 24 and 48 hours of drying at ambient conditions respectively after the first and second applications in accordance with the instructions provided by the manufacturer. Testing of the coated sample showed that, under the influence of flame, the paint coating exfoliates from sheetrock forming an air pocket between them. The exfoliated layer has low strength and disintegrates readily even under a slight mechanical influence. Thus, direct application of an intumescent paint to a sheetrock does not provide a combination which complies with the requirements of fire-protective materials. With the aim of improving adhesion of the coating to the sheetrock surface, the latter was treated with a primer, a conventional contact cement glue. Contact cement was also used in preparation of sheetrock samples in combination with SM-F material. In this case, contact cement was applied to both sheetrock and SM-F surfaces (160×160 mm). Upon drying for 15-20 minutes, the sheetrock and SM-F surfaces were brought into contact. The thickness of the SM-F layer was 2 mm.

The test results for sheetrock SM-F samples are shown in Table 1.

TABLE 1

| | FPR, min. up to °C. | | | |
|---|---|---|---|---|
| Sample description | 130 | 170 | 212 | 300 |
| Sheetrock without coating. | 9 | 11 | 12 | 15 |
| Sheetrockwith 10-10 intumescent coating. | Coating exfoliates from sheetrock forming an air pocket. | | | |
| Sheetrock with contact cement as a primer & 10-10 intumescent coating. | 18 | 22 | 24 | 27 |
| Sheetrock with SM-F layer. | 25 | 27 | 30 | 36 |
| Sheetrock with SM-F layer & 10-10 intumescent coating. | 38 | 1+ hour | 1.5+ hours | 2+ hours |

As can be seen from Table 1, coating sheetrock with intumescent paint 10—10 (using contact cement as a primer) doubles the FPR. The presence of an SM-F layer is even more effective by a factor of 2.5. However, the combination of the ablative layer with an intumescent paint coating provides an improvement many times that of either the ablative material layer or the intumescent paint coating separately. In this case, the heat-insulating property of the system is much more than additive, i.e. a clearly defined synergistic effect is observed. It was found that the synergistic effect described above manifests itself with other substrates as well, and is especially effective at the higher temperatures above 130°-150° C. As can be seen from Table 1, the FPR of the ablative/intumescent combination is 10 times better than the FPR of the sheetrock alone at 170°, 212° and 300° C.; if this were merely an additive effect, the improvement in FPR would be no more than a factor of about 4.5.

EXAMPLE 2

This example was similar to Example 1 except that instead of sheetrock, a 1.6 mm. thick aluminum plate was used. The test data are shown in Table 2.

TABLE 2

| | FPR, min. up to °C. | | | |
|---|---|---|---|---|
| Sample description | 130 | 170 | 212 | 300 |
| Metal without coating | — | — | 0.5 | 35 sec. |
| Metal coated with 10-10 | 30 sec. | 50 sec. | 1.3 | 1.5 |
| Metal protected by SM-F | 9 | 12 | 17 | 20 |
| Metal + SM-F + 10-10 paint | 20-30 | 25-50 | 40-60 | 60+ |

As can be seen from Table 2, the application of the 10—10 paint alone for metal protection is not effective. The combination of SM-F with the 10—10 paint more than doubles the protection provided by the SM-F alone. When the surface is heated above the 130°-150° C. range, the synergistic effect is even more pronounced than that shown in Example 1 with sheetrock. The actual FPR of the SM-F/10—10 paint combination is more than twice what would be predicted if the effect was merely additive.

EXAMPLE 3

This test was similar to Example 2 but, instead of the 10—10 paint, other intumescent type paints were evaluated. The testing results are shown in Table 3.

TABLE 3

| | FPR, min up to °C. | | |
|---|---|---|---|
| Type of paint utilized. | 130 | 170 | 212 |
| SM-F without paint | 9-10 | 12-14 | 16-21 |
| FC 20-20 (Flame Control, Inc.) | 18-20 | 20-30 | 35-50 |
| Flaymbar 9788 (Ocean Coating, Inc.) | 17-21 | 30-40 | 1+ hr. |
| Ocean 477 (Ocean Coating, Inc.) | 15-20 | 25-30 | 40-50 |

As can be seen from Table 3, the paints tested are slightly less effective than the FC 10—10 paint; neverless, even they improve the FPR rating of SM-F by a factor of about 2 or more when utilized in combination with the SM-F.

EXAMPLE 4

This test was similar to Example 1 but instead of sheetrock, a 10 mm thick piece of construction wood was used. The test results are shown in Table 4.

TABLE 4

| Coating type | FPR, min. up to °C. 130 | 170 | 212 |
|---|---|---|---|
| Without coating | 5 | 6 | 8 |
| FC 10-10 paint | 12 | 18 | 21 |
| SM-F | 19 | 30 | 33 |
| SM-F + 10-10 paint | 31 | 70 | 80 |

As can be seen from Table 4, protection of wood with the intumescent paint or the ablative material provides 2 to 4 times the improvement in the FPR rating, respectively. The combination of these materials, however, gives 6 to 10 times the improvement which is at least 30% better than the protection time by the ablative material alone. The synergistic improvement in FPR at the higher temperatures is about 1.5 times more than the mere additive effect of the components.

From the foregoing examples it can be seen that the combination of the ablative material with the intumescent paint provides significant improvement in FPR rating for metal, wood, and sheetrock with at least a 30% higher FPR rating than the ablative material or the intumescent paint taken separately. These results (Examples 1–4) were obtained using a flame temperature of about 930±25° C. In order to check the effect of higher flame temperature, additional tests were run.

EXAMPLE 5

The samples were similar to those described in Example 2 except that testing was carried out at 1550±50° C. flame temperature. The results are summarized in Table 5.

TABLE 5

| Sample type | FPR, min. up to °C. 130 | 170 | 212 |
|---|---|---|---|
| Metal without coating | — | — | 0.25 |
| Metal coated with 10-10 | 0.3 | 0.6 | 1 |
| Metal protected with SM-F | 1.5 | 1.7 | 2.2 |
| Metal protected with SM-F + 10-10 intumescent paint | 2.5 | 2.8 | 3.5 |

As shown by Table 5, the samples protected by the ablative material in combination with the intumescent paint have a 60% better FPR rating than the corresponding samples protected by the SM-F alone. Even better results were obtained when the thickness of the SM-F was increased from 2 to 4 mm. In the latter case, the FPRs at 130°, 170° and 212° C. were 9, 11 and 13 minutes, respectively.

EXAMPLE 6

This example was similar to Example 1 except that a plaster, SM-P, was utilized as the ablative coating. After complete drying (3 weeks storage at ambient conditions), the samples were tested in the manner described in Example 1. The resulting data are shown in Table 6.

TABLE 6

| Sample type | FPR, min. up to °C. 130 | 170 | 212 |
|---|---|---|---|
| Sheetrock without coating. | 9 | 11 | 12 |
| Sheetrock coated with FC 10-10 intumescent paint (contact cement used as a primer). | 19 | 22 | 25 |
| Sheetrock protected by 3 mm thick SM-P coating. | 22 | 25 | 26 |
| Sheetrock + SM-P coating (3 mm thick) + FC 10-10 intumescent paint. | 34 | 38 | 43 |

As is shown in Table 6, the intumescent paint and the ablative plaster improve the FPR rating of sheetrock to the same extent as in the prior examples (about 2 times improvement when compared to unprotected sheetrock). The combination of the paint and plaster improves the FPR more than 3 times.

EXAMPLE 7

SM-P plaster was used for the preparation of a test plate (160×160×6 mm). After complete drying (3 weeks storage at the ambient conditions), the plate was coated with FC 10—10 intumescent coating and tested utilizing the procedures described in Example 1. The test data are presented in Table 7.

TABLE 7

| Sample type | FPR, min. up to °C. 130 | 170 | 212 |
|---|---|---|---|
| SM-P plate without coating. | 17 | 19 | 20 |
| SM-P plate coated with intumescent paint | 25 | 30 | 32 |

As is shown by Table 7, the application of the FC 10—10 intumescent paint increases the plate FPR by about 50%.

EXAMPLE 8

This example is essentially the same as Example 6 except that the substrate was 10 mm. thick construction wood. The test data are shown in Table 8.

TABLE 8

| Sample type | FPR, min. up to °C. 130 | 170 | 212 |
|---|---|---|---|
| Wood without coating | 5 | 6 | 7 |
| Wood coated with intumescent paint. | 12 | 18 | 26 |
| Wood coated with SM-P (4.5 mm) | 34 | 46 | 68 |
| Wood coated with 4.5 mm SM-P + FC 10-10 intumescent paint. | 48 | 1.5+ hrs. | 2+ hrs. |

As is shown in Table 8, the application of both the SM-P plaster and the FC 10—10 intumescent paint is about 1.5 times more effective (in terms of FPR rating) than the application of each of them separately.

EXAMPLE 9

This test was similar to Example 6 except that a 1.6 mm thick aluminum plate was used as a substrate. It was found that the SM-P plaster separates from aluminum during fire testing. In order to improve adhesion of the plaster to the aluminum plate, the latter was coated with the automobile sandable primer "Nu-Hue" (Dupli-color Product Co.) prior to the application of plaster. The test results are shown in Table 9.

TABLE 9

| Sample type | FPR, min. up to °C. 130 | 170 | 212 |
|---|---|---|---|
| Aluminum plate with primer. | — | — | 43 sec. |
| Aluminum plate with FC 10-10 intumescent paint (two coats). | 40 sec. | 63 sec. | 1.5 |

TABLE 9-continued

| Sample type | FPR, min. up to °C. | | |
|---|---|---|---|
| | 130 | 170 | 212 |
| Aluminum plate with primer + 2.5 mm thick layer of SM-P. | 8 | 13 | 17 |
| Aluminum plate + primer + SM-P (2.5 mm thick) + FC 10-10 intumescent paint (2 coats). | 12 | 21 | 28 |

From Table 9 it can be seen that application of both SM-P and FC 10—10 paint is about 1.5 times more effective than the application of SM-P alone, and greatly exceeds the additive value for the individual components.

From all of the foregoing examples, it can be concluded that the application of the combination of the ablative coating with the intumescent paint leads to a better protection against fire (higher FPR testing) than the utilization of the ablative coating or the intumescent paint alone. In this case, the obtained values of FPR are better than their additive values, i.e. a synergistic effect is observed. The latter increases as the flame temperature applied to the protected surface increases.

What is claimed is:

1. The method of protecting construction materials from the thermal effects of fire comprising applying to said construction material a layer of an aluminum sulfate-based ablative protective material, the exposed surface of which is coated with an intumescent paint.

2. A method in accordance with claim 1 in which said construction material is wood, sheetrock, or metal sheet.

3. A method in accordance with claim 2 in which said intumescent material is a water-based latex paint.

4. A method in accordance with claim 2 in which said intumescent material is an epoxy paint.

5. A method in accordance with claim 2 in which intumescent material is an organic solvent-based paint.

6. A material for the protection of construction materials against the thermal effects of fire comprising a layer of an aluminum sulfate-based material having one surface adapted for fixing to the surface of construction material and the opposing surface of which is coated with an intumescent paint.

* * * * *